US005518220A

United States Patent [19]

Bertrand et al.

[11] Patent Number: 5,518,220

[45] Date of Patent: May 21, 1996

[54] LIFTING DEVICE FOR A VEHICLE

[75] Inventors: Frelet Bertrand, St Foy les Lyon; Montcel Michel, St Etienne; Wafflard Serge, Montherme, all of France

[73] Assignee: SEFAC Equipement (Societe Anonyme), Feugerolles, France

[21] Appl. No.: 241,711

[22] Filed: May 12, 1994

[30] Foreign Application Priority Data

Jul. 21, 1993 [FR] France ..... 93 09151

[51] Int. Cl.[6] ..... B66F 7/14

[52] U.S. Cl. ..... 254/7 B; 254/89 R; 254/98

[58] Field of Search ..... 254/84 R, 98, 254/92, 103, 2 R, 2 B, 2 C, 7 R, 7 B, 7 C; 187/206, 214

[56] References Cited

U.S. PATENT DOCUMENTS 3,958,664 5/1976 Perkins ..... 254/89 R
4,022,428 5/1977 Mantha ..... 254/89 R
4,173,268 11/1979 Nussbaum ..... 187/214
4,319,738 3/1982 Nussbaum ..... 254/84 R

*Primary Examiner*—Robert C. Watson
*Attorney, Agent, or Firm*—Greenblum & Bernstein

[57] ABSTRACT

A lifting device for a load, such as a vehicle, includes a substantially vertical column forming a frame and a lifting device movable along the column under the action of a rotation control of a threaded ball driven by a driving unit, a reversible-type nut, such as a ball nut, for moving along the threaded rod, and a friction unit capable of creating, during a control of a down movement of the lifting device, a resistance torque of a modulus at least equal to a torque generated by the load resting on the lifting device. The lifting device also including a device capable of overcoming the friction unit during a control of an up movement of the lifting device and a load-dividing unit for transmitting, at a level of the friction unit, only a proportional part of the load lifted by the lifting device.

15 Claims, 2 Drawing Sheets

LIFTING DEVICE FOR A VEHICLE

BACKGROUND OF THE INVENTION

1. Field of the Invention

The invention relates to a lifting device, viz. for a vehicle, comprising, one the one hand, a substantially vertical column forming a frame and lifting means movable alongside said column under the action of the rotation control, through appropriate driving means, of a threaded rod and the movement alongside this latter of a reversible-type nut, such as a ball nut made of polyamide, compound material or the like, and, on the other hand, friction means capable of creating, during the control of the down movement of the lifting means, a resistance torque of a modulus at least equal to the torque generated by the load resting on these lifting means, as well as means capable of annihilating the action of the friction means during the control of the up movement of said lifting means.

2. Description of the Prior Art

With a view to carrying out repairs on light motor vehicles, there exist lifting ramps onto which vehicles can be positioned. However, these lifting ramps generally are not feasible for larger-size and heavier-weight vehicles, e.g., a large vehicle for transport of goods or the public or even one or several railway vehicles. In such cases, lifting devices corresponding to the above description are often used. More particularly, these lifting devices are in the shape of a vertical column forming a frame and resting on the ground, through a base. It should be noted that the base is usually provided with rollers allowing movement of the lifting device and thus enabling bringing the same device into the vicinity of the vehicle to be lifted. Alongside this vertical column are moving lifting arms in the shape of one or several horizontal arms, each associated with a movable carriage. The movable carriage is guided in movement alongside the column through guiding rails and provided with a set of rollers. As regards the control of the movement of the carriage, this is achieved especially through a vertical threaded rod rotatingly fitted inside the column and capable of being driven by driving unit, e.g., an electric engine, situated at the top of the column. Furthermore, a nut made integral with the lifting means is fitted onto the threaded rod so that during the rotation control of the rod the nut moves up or down, thereby driving the lifting device.

It is obvious that these lifting devices for lifting relatively heavy loads include a number of safety devices impeding the load from moving down during any failure, e.g., of the driving unit.

More particularly, within the framework of a normal operation these driving units provide a resistance torque largely higher than the torque exerted onto the threaded rod through the lifted load. Thus, unless the operation of these driving means is controlled, this load can in no way move down. This is obviously no longer so in the event of a failure of these driving units. For this purpose, there is often used a nut, e.g., made of bronze, the spiral line of the thread pitch being determined so that it leads to a resistance torque in particular higher than the torque generated during the down movement by the lifted load. Such a nut is called irreversible.

Thus, though this irreversible nut meets the above-mentioned requirements, it has notwithstanding a number of drawbacks in that it leads to a low efficiency and a high power absorption as well as heating power generation. Therefore, the driving unit should be of an accordingly high power. Furthermore, the use of a lubricating system is absolutely necessary.

As a result, these kinds of lifting devices with an irreversible nut are of a high cost price, especially because of the presence of a powerful electric engine. It should be noticed by the way that the electric-energy supply of these powerful electric engines may give rise to problems when lifting a large-size vehicle, e.g., of the railway-vehicle type, requiring the use of several lifting devices. Since these lifting devices are necessarily simultaneously controlled, they do indeed imply a large electrical-energy requirement.

An alternative to bronze irreversible nuts is reversible nuts with a high efficiency, such as ball nuts or nuts made of polyamide or compound material. Of course, their reversibility brings the drawback of an inexisting safety in the event of failure of the driving means. More particularly, in such circumstances, the torque generated by the load is largely higher than the resistance torque of the reversible nut. As a consequence, this results into almost instantaneous moving down of the lifting device and the fall of the load.

In order to cope with these kinds of drawbacks, it has been contemplated to fit the lifting device with friction devices capable of creating, during the control of the down movement of the lifting means, a resistance torque capable of opposing the torque generated by the load resting on these lifting devices. However, devices capable of overcoming the action of the friction devices are required during the control of the up movement of the lifting devices.

More particularly, the threaded rod is hanging at its upper end, through a bearing block located on top of the column. This bearing block includes a casing defining a cylindrical recess into which penetrates in particular this upper end of the threaded rod. The threaded rod is provided, at this level, with a shoulder resting onto a thrust ball bearing which, in turn, rests on the outer cage of a free wheel arranged inside the cylindrical recess defined at the level of the bearing block.

In fact, this free wheel forms the device capable of overcoming the actions of the friction devices during the control of the up movement of the lifting means. More particularly, this free wheel fitted onto the upper end of the threaded rod leads to the driving of this outer cage only when the threaded rod has penetrated in the rotating direction, causing the lifting means to move down. As a result, in the opposite rotation direction, the outer cage of this free wheel is not driven, whereby the same is impeded from causing the friction devices to act. The friction devices are in the shape of friction discs arranged on the bottom of the bearing block and onto which rest the outer cage of the free wheel.

In fact, the drawback of such a construction resides in that, irrespective of the lifted load, it fully rests on the friction device, through the cage of the free wheel. Thus, when the lifting devices bear a heavy load, these friction devices are highly stressed, so that they quickly wear off and lead to a considerable heating.

SUMMARY OF THE INVENTION

The scope of this invention is to cope with these drawbacks while retaining all the advantages related to the use of a nut of a reversible kind. The reversible nut is associated, on the one hand, with a friction device capable of creating, during the control of the down movement of the lifting device, a resistance torque of a modulus at least equal to the torque generated by the load resting on the lifting device and, on the other hand, with a device capable of overcoming the action of the friction device during the control of the up movement.

For this purpose, the invention relates to a lifting device, e.g., for a vehicle, including a substantially vertical column forming a frame and a lifting device movable alongside the column under the action of a rotation control, through an appropriate driving unit, of a threaded rod. The movement alongside the threaded rod is via a reversible-type nut, such as a ball nut made of polyamide, compound material or the like. A friction device capable of creating, during the control of the down movement of the lifting device, a resistance torque of a modulus at least equal to the torque generated by the load resting on the lifting device, and a device capable of overcoming the action of the friction device during the control of the up movement of the lifting device, characterized in that the lifting device includes a load-dividing unit in order to transmit, at the level of the friction device, only a proportional part of the load lifted by the lifting device.

The advantages achieved thanks to this invention are obvious. By properly selecting the materials from which the friction devices are made, proper selection being within the purview of the specialists, it is indeed easy to achieve the desired resistance torque at the moving down of the lifting device without imparting to the friction device the entire weight of the lifted load. These friction devices are therefore subjected to a lesser stress, so that they are worn less quickly and above all that they generate a smaller release of heat.

Other scopes and advantages of this invention will appear during the detailed description which follows relating to embodiments which are schematically shown in the attached drawings.

DESCRIPTION OF THE PREFERRED EMBODIMENTS

Figure 1:
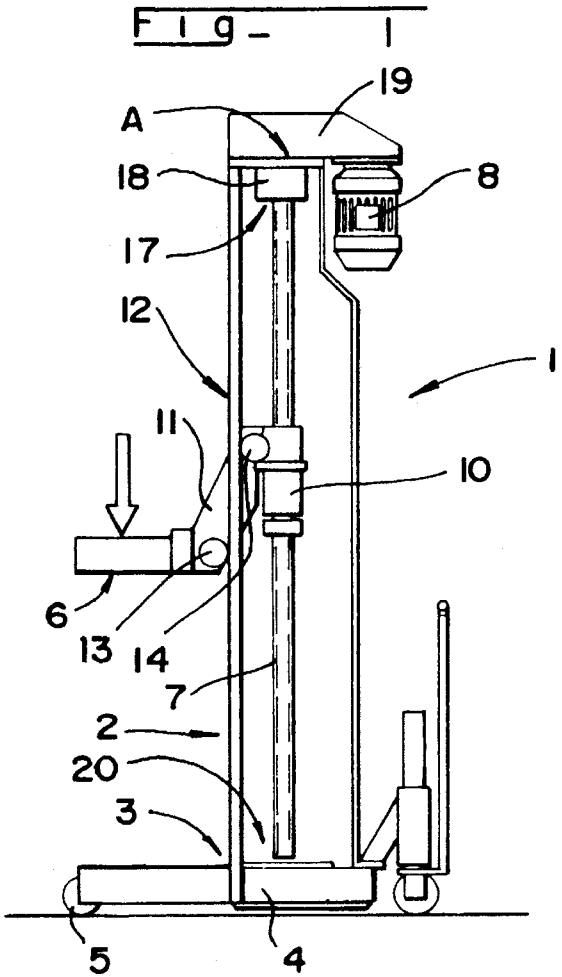
FIG. 1 is a schematic elevational view of a lifting device according to the invention.

The invention as shown in FIG. 1 of the attached drawing more particularly relates to a lifting device 1, e.g., for lifting vehicles. This lifting device 1 is characterized by a substantially vertical column 2 forming a frame and resting on the ground, through a base 4. It should be noted that this base 4 may be provided with eventually withdrawable rolling means 5 authorizing a certain movability of this lifting device 1.

This latter is furthermore provided with lifting means 6 capable of being placed under a vehicle, either directly under the frame of same or even under a wheel, these lifting means 6 being vertically movable alongside said column 2. In fact, at a level of column 2, more particularly in its central portion, extends a threaded rod capable of being rotatingly driven through appropriate driving means 8. Furthermore, a nut 10 is fitted onto this threaded rod 7 and moves alongside the rod during the control of the rotation by the driving means 8. Since this nut 10 is made integral with the movable carriage 11 forming the lifting means 6, the lifting means are capable of moving down or up depending on the direction of rotation imparted to the threaded rod 7.

It should be noted, in addition, that the column 2 may be fitted with guiding means 12, such as channel on both sides thereof; into which rest rollers 13, 14 of the movable carriage 11 are positioned. This arrangement nullifies the twisting forces at the level of the threaded rod 7.

According to the invention, the use of a reversible-type nut 10 is preferred, such a ball nut, made of polyamide, of compound material or the like, which has the advantage of providing reduced friction forces and, accordingly, a good efficiency. However, the drawback of these reversible nuts resides in that, under the action of the load resting on the lifting means 6, they are incapable of impeding the lifting means from moving down in the event of breakage of the driving means 8, i.e., the driving means must be operational to prevent the threaded rod 7 for rotating.

Figure 3:
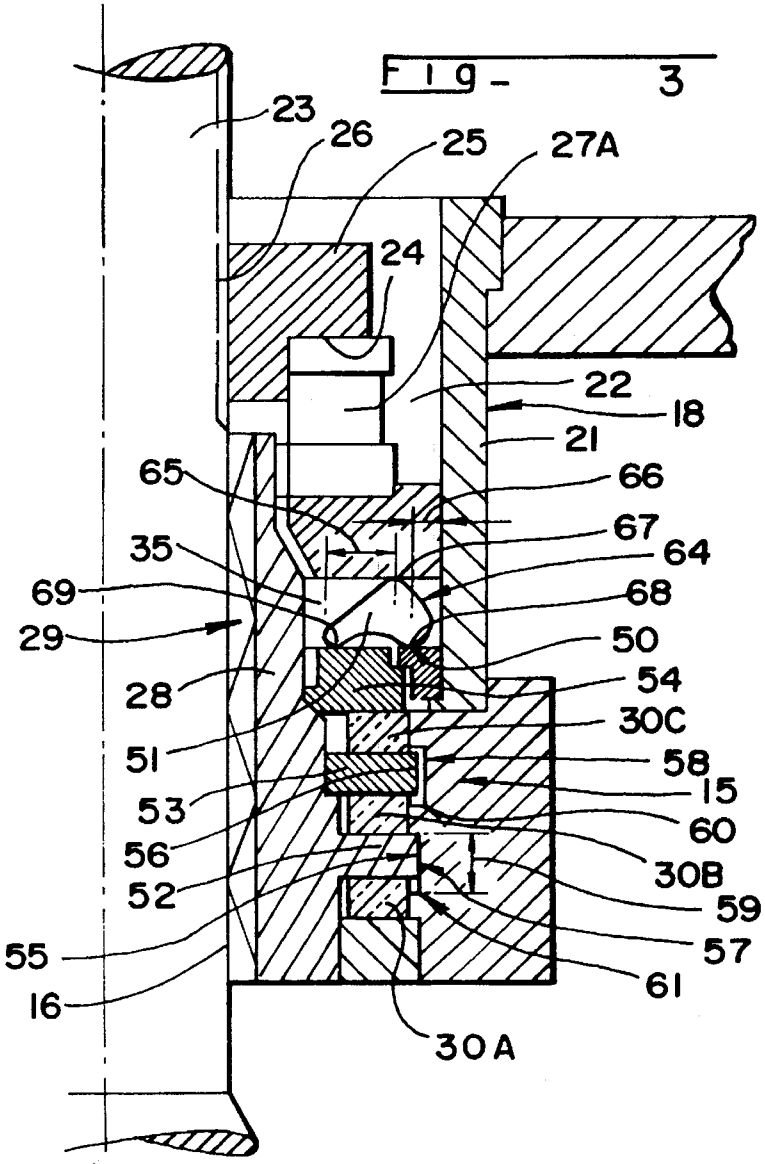
FIG. 3 is a view analogous to FIG. 2 in that it schematically shows; partly in cross-section, another embodiment of the load-dividing means the function of which is to avoid the full load lifted by the lifting means from fully resting on the friction means capable of creating a resistance torque during the control of the down movement of the lifting means.
Figure 2:
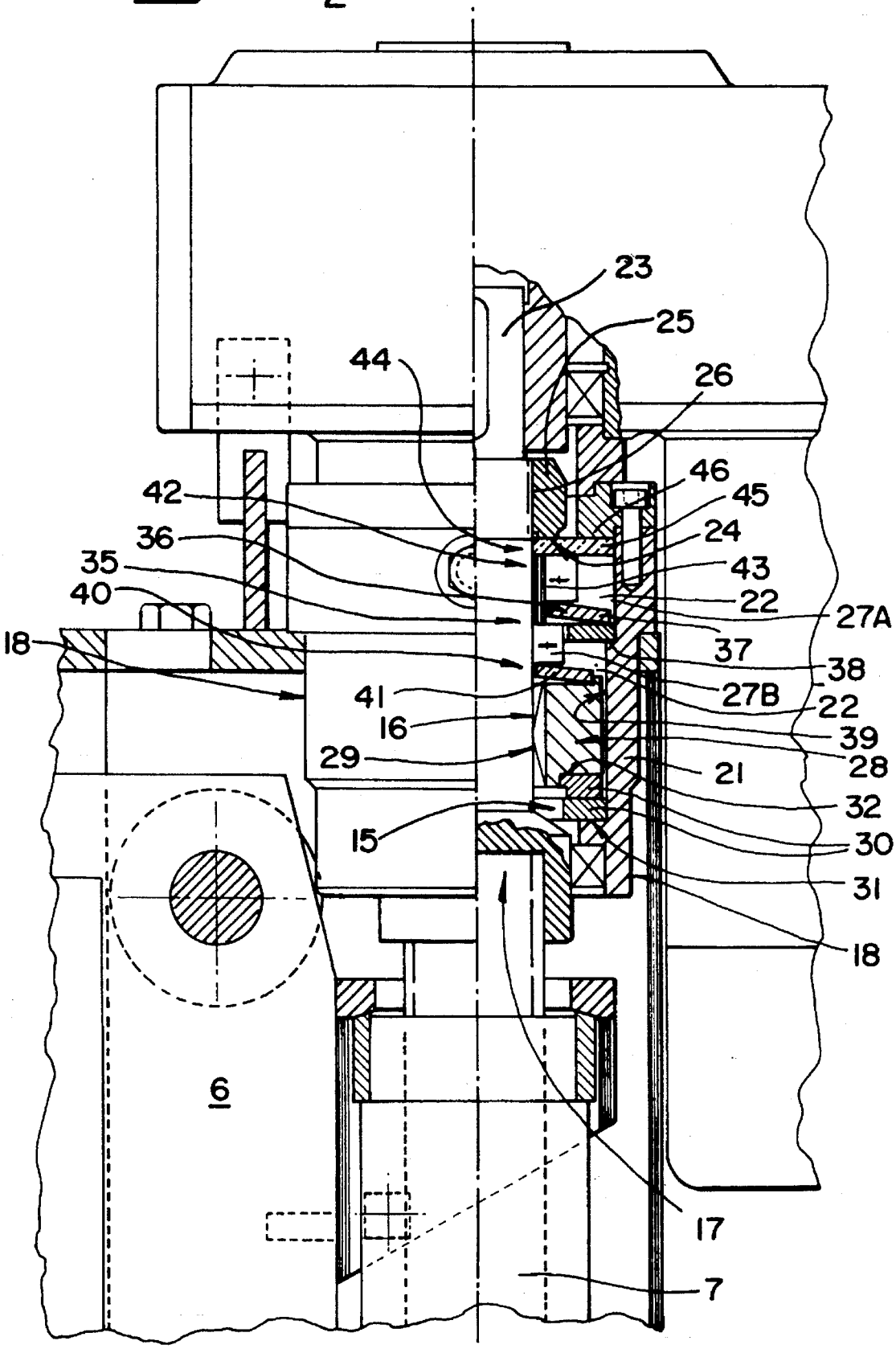
FIG. 2 is a schematic and partial cross-sectional view of the detail marked A in FIG. 1, and corresponds to a first embodiment according to the invention.

Therefore, the lifting device 1 as shown in the FIGS. 2 and 3 includes friction means 15 capable of creating, during the control of the down movement of the lifting means 6, a resistance torque of a modulus at least equal to the torque generated by the load lifted and means 16 capable of overcoming the action of the friction means 15 during the control of the up movement of the lifting means 6.

As shown in FIG. 1, corresponding to a specific embodiment of the invention, the threaded rod 7 is hanging at its upper end 17, through a bearing block 18 located on top 19 of the column. Furthermore, coupled to top 19 of the column is the driving means 8 and rotation control means for rotating the threaded rod 7.

It should be noticed that though the following description refers to such an embodiment, this invention is in no way limited thereto in that it will also find its application in that situation in which the threaded rod 7, instead of being hanging, rests at its lower end 20 and through a bearing block on the base 4. As far as the driving means 8 are concerned, this too may be located at the level of base 4 of the lifting device 1 or even be maintained on top 19 of the column.

According to a preferred embodiment, the friction means 15 as well as the means 16 for overcoming the action of the friction means during the control of the up movement of the lifting means 6 are installed at the level of the bearing block 18 supporting the threaded rod 7 in rotation, irrespective of whether bearing block 18 is located at the upper end 17 or at the lower end 20 of the rod.

Thus, according to an embodiment shown in FIG. 2, the bearing block 18 includes first of all a casing 21 defining a cylindrical recess 22 into which usually penetrates the end, in this case the upper end 17, of the threaded rod 7.

More particularly, this upper end 17 of the threaded rod 7 is characterized by a tip 23 capable of co-operating with the transmission means connected to the driving means 8. Immediately before this tip 23, the upper end 17 of the threaded rod 7 defines a shoulder 24 which can be achieved, as shown in this FIG. 2, by means of a side plate 25 including at its center a tapped hole capable of co-operating with a threaded portion 26, provided for at this upper end 17 of the threaded rod 7.

In fact, by means of the shoulder 24, said threaded rod 7 rests onto a thrust ball bearing 27A also arranged inside the recess 22 defined by the casing 21.

Moreover, the thrust ball bearing 27A indirectly rests on the outer cage 28 of a free wheel 29 forming the means 16 capable of overcoming the action of the friction means 15 during the control of the up movement of the lifting means 6. More particularly, this free wheel 29 fitted onto the upper end 17 of the threaded rod 7 causes this outer cage 28 to be driven only when said threaded rod 7 is driven in the rotation direction corresponding to the down movement of the lifting means 6. Accordingly, in the opposite rotation direction, said outer cage 28 of this free wheel 29 is not driven, whereby it is impeded from causing the friction means 15 to act. The friction means 15 is in the shape of a friction part, e.g., designed in the shape of one or several friction discs 30. The outer case 28 of the free wheel 29 acts on the friction part, either directly by resting on the friction part or through an appropriate transmission part.

It is obvious that the resistance torque to which these friction means 15 lead depends, on the one hand, on the material which the friction part, here the disc or discs 30, is made of as well as on the contact surface 32 existing between the friction part and the outer cage 28 of the free wheel 29. Thus, the contact surface 32 as well as the materials to be used for manufacturing the friction part shall be determined according to the load capable of being lifted by the lifting device 1.

It should be noticed that it is obvious to apply the bearing block 18 as shown in FIG. 2 in a situation in which the threaded rod 7 is not hanging, but rests, in particular through such a bearing block 18, on the base 4 of the lifting device 1. This bearing block 18 indeed keeps an identical structure, only the threaded rod 7 being in such circumstances in an upside down position.

One very well understands that the disc or discs 30 forming the friction part will wear off in the course of time and that it is convenient to replace the same beyond a given rate of wear. To this end, the lifting device may be fitted with a wear indicator for the friction part, e.g., in the shape of an electric or electronic pick-up, so that, once it is worn out, this pick-up controls the operation of a light and/or sound indicator and maybe even with means for interrupting the control of the up movement of the lifting means 6. In addition, this ear can also be visually detected by the operator, e.g., by monitoring the down movement of the threaded rod 7 resulting from this wear.

In order to avoid any incident in the event of malfunctioning of the wear indicator or the operator does not respect the instructions, there is in addition provided for the outer cage 28 of the free wheel 29 to come into contact with a friction surface, e.g., one of the discs 30 or the bottom 31 of the recess 22 in the event the rate of wear of the friction part is exceeded, providing such a friction coefficient that the resistance torque which it leads to during the control of the down movement of the lifting means is higher than the power of the driving means 8. As a matter of fact, in the event the operator did not heed the preferred instructions for replacing the friction part, i.e., opting instead for periodical replacement of the disc or discs 30, there will come a time at which the down movement of the lifting means 6 can almost no longer occur by means of the usual driving means 8, unless one e.g., proceeds stepwise and taking his time, this in order to force the operator to replace the disc or discs 30.

It is obvious that, instead of coming into contact with the bottom 31 of the recess 22, the outer cage 28 of the free wheel 29 may, in the event of wear of the disc or discs 30, rest on another disc which will in particular be capable of providing the desired friction torque.

As stated above, the resistance torque which the friction means 15 must lead to should be at least equal, in modulus, to the torque generated by the load resting on the lifting means 6. However, this resistance torque will be determined through an election of appropriate material for the design of the friction part as well as a properly sized contact surface 32. According to the invention, this resistance torque will be determined so as to lead to a torque, necessary during the down movement, in the range from 75% to 95%, preferably 90%, of the one the driving means 8 should provide during the up movement. Of course, this torque which the driving means 8 should provide is proportional to the load resting on the lifting means 6.

Accordingly, it should be noticed that though a reversible-type nut offers the advantage of a high efficiency authorizing the use of low-power driving means, this advantage is in no way nullified by the use of friction means 15 as provided for by the invention.

It is obvious that when the lifting means 6 bear a heavy load and the weight of this load fully rests on the friction disc or discs 30, these discs are highly stressed, so that there is a considerable heating and an increased wear of these discs.

Since it is easy to achieve, by means of such friction discs 30, a resistance torque largely higher than the above requirements, this through an election of materials and contact surfaces easy to be determined by the specialists, there has been imagined to fit the lifting device according to the invention with load-dividing means 35, in order to transmit at the level of the friction means 15 only a limited load which however remains proportional to the lifted through the lifting means 6. This results into a lesser heating of friction means 30 during the control of the down movement of the lifting means 6 through the driving means 80. Friction means 30 is comprised of a resistance torque which is at least equal, in modulus, to the torque generated by the load resting on said lifting means, i.e., preferably in the range from 75% to 95% of the torque the driving means 8 should provide during the up movement.

FIGS. 2 and 3 show two embodiments of such load-dividing means 35 which are interposed between the shoulder 24 and the free wheel 29, more particularly the outer cage 28 of same. However, one can imagine to also install these load-dividing means 35 between the free wheel 29 and the friction means 15. Finally, such load-dividing means 35 the function of which is to avoid the load from being totally transmitted onto the friction means 15 could adopt a completely different location, e.g., alongside the threaded rod 7, to achieve this result.

Thus, according to the embodiment corresponding to FIG. 2, these load-dividing means 35 are in the shape of springy compensating means 36 capable of absorbing part of the load the threaded rod 7 bears, so that this load is not fully directed, through the free wheel 29, onto the friction means 15.

As shown in FIG. 2, the springy compensating means 36 take the shape of a first spring washer 37 resting onto an internal shoulder 38 provided for at the level of the inner wall 39 of the casing 21. On this spring washer 37 rests the threaded rod 7 and, accordingly, the load lifted by the lifting means 6, this through the shoulder 24 defined by the side plate 25. It should be noticed that between this shoulder 24 and said spring washer 37 is interposed the thrust ball bearing 27A. Thus, under the weight of the load, said threaded rod 7 substantially moves down, so that part of this load is directly transmitted through said spring washer 37 onto the casing 21. In addition, the load transmitted onto the friction means 15 is directly proportional to the length of this lowering of said threaded rod 7. More particularly, said threaded rod 7 rests on said friction means 15, e.g., through other springy means 40, so that this results, under the action of the moving down of said threaded rod 7 by a length proportional to the load lifted and compensated by the springy compensating means 36, into the compression of these other springy means 40 and into the transmission onto the friction means of a proportionally reduced load. It should be noticed that as far as the ratio of the load transmitted onto the friction means 15 to the one borne by the threaded rod 7 is concerned, this is equal to the ratio of the stiffness coefficients of the first springy compensating means 36 to the second springy means 40.

Within the framework of the embodiment shown in FIG. 2, the second springy means 40 adopt, like the first springy compensating means 36, the configuration of a spring washer 41 interposed between the free wheel and the shoulder 24 of said threaded rod 7. More particularly, between this shoulder 24 and this spring washer 41 are interposed spacer means 42 authorizing the installation inside the casing 21 of the spring washer 37 and the thrust ball bearing 27A. Thus, these spacer means 42 include a tubular spacer 43 extending under the shoulder 24 and resting at its lower end onto a second thrust ball bearing 27B resting onto the spring washer 41.

It should be noticed that as far as the springy means 36 and/or 40 are concerned, these may adopt a structure different from that of a spring washer 37, 41. In addition, the load-dividing means 35 may be positioned anywhere alongside the thread rod 7, e.g., at the height of its lower end. Most particularly, the springy compensating means 36 may be arranged under the lower end of this threaded rod 7, in particular to compensate for the load which is associated to same through the lifting means 6. As far as the springy means 40 are concerned, the function of which is to compensate for the length variations which may undergo the connection between the threaded rod 7 and the friction means 15, these may be arranged under the friction parts 30 forming these latter. As a matter of fact, this compensation of the variation in distance may be carried out between these friction parts 30 and their bearing surface 31.

Within the framework of FIG. 2, there are also shown braking means 44 capable of entering into operation in the event of moving up and moving down of the lifting means 5 under no or little load. More particularly, in the case of an operation under such circumstances, neither the load lifted during moving up nor the resistance torque provided by the friction means 15 during moving down are capable of forming efficient braking means capable of mitigating the inertia of the driving means and, accordingly, of the rotation of the threaded rod 7 when arriving at the upper or lower travel end. More particularly, under the action of this inertia, these upper and lower travel ends may be exceeded so that the lifting means 6 strike against the bearing block 18 at the upper end 17 of the threaded rod 7 or the base 4 of the lifting device.

According to the embodiment shown in FIG. 2, these braking means 44 are formed by a braking disc 45, which in the event of an operation under no or little load, thus in raised position of the threaded rod 7, strikes against a braking surface 46, thus providing the desired motor braking.

Reference is now made to the embodiment shown in FIG. 3. Thus, here we have once again, at the level of the upper end 17 of the threaded rod 7, the shoulder 24 achieved e.g., by means of a side plate 25, including at its center a tapped hole capable of co-operating with a threaded portion 26 corresponding to said upper end 17 of the threaded rod 7.

The shoulder 24 rests onto a thrust ball bearing 27A which indirectly rests, i.e., through the load-dividing means 35, on the outer cage 28 of a free wheel 29. Free wheel 29 forms the means 16 capable of overcoming the action of the friction means 15 during the control of the up movement of the lifting means 6.

As far as the friction means 15 are concerned, these are in the shape of one or several friction discs 30.

Similar to the embodiment of FIG. 2, all these members are installed at the level of the bearing block 18 rotatingly bearing the threaded rod 7, at the height of the upper end 17. However, as stated above, it is easy to imagine such a bearing block 18 at the lower end 20 of the threaded rod 7.

As far as this bearing block 18 is concerned, this includes a casing defining a cylindrical recess 22 into which, on the one end, penetrates the upper end 17 of the threaded rod 7 and, on the other hand, are positioned all the above-mentioned means, i.e., the friction means 15, the means 16 capable of overcoming their action during the control of the up movement of the lifting means 6, as well as the load-dividing means 35.

Within the framework of the embodiments corresponding to FIG. 3, load-dividing means 35, the function of which is to ensure the transfer, at the level of the friction means 15, of only a proportional part of the load lifted by the lifting means 6 are formed by lever-arm load-transfer means 64. Thus, load transfer means 64 are capable of ensuring the transfer of part of the lifted load directly onto the frame of the lifting device, this through a lever arm 65 of an appropriate length to transmit to the friction means 15 only part of this lifted load through another lever arm 66.

Actually, the length of the lever arms 65 and 66 is determined as a function of the distance separating the bearing point 67 at the level of which the thrust ball bearing 27A rests on the lever-arm load-transfer means 64 from the bearing points 68, 69 of these load-transfer means 64 on the defined frame of the lifting device and the friction means 15, respectively. More particularly, the lever-arm load-transfer means 64 rest, at the level of their bearing point 68, on a rim 50 provided for at the level of the inner wall of the recess 22 and on the friction means 15, respectively.

In fact, the lever-arm load-transfer means 64 are defined by several parts 51, at least three in number, distributed around the threaded rod 7, under the thrust ball bearing 27A and the shape of which is defined so as to obtain the bearing points 67, 68, 69 and, accordingly, to obtain the desired length of the lever arms 65, 66.

Here too, it should be reminded that the length of the lever arms 65, 66 and, accordingly, the part of the load transferred onto the friction means 15 is determined according to the material the friction discs 30 are made of, knowing that the aim is to achieve through the friction discs a resistance torque during the control of the down movement of the lifting means 6 at least equal, in modulus, to the torque generated by the load resting on said lifting means 6. Preferably, this torque should represent from 75% to 95%, preferably 90%, of the torque the driving means 8 should provide during the up movement.

Within the framework of the embodiment corresponding to FIG. 2, the load-dividing means 35 are interposed between the thrust ball bearing 27A and the outer cage 28 of the free wheel 29 which directly acted into the friction discs 30. In fact, in the embodiment corresponding to FIG. 3, there is shown another mounting solution in that, in this case, the outer cage 28 of this free wheel 29 includes a peripheral rim 52 which is sandwiched between two friction discs 30A and 30B immobilized in rotation inside the recess 22, the first one 30A resting on the bottom 31 of this latter.

In addition, in this embodiment corresponding to FIG. 3, there has been shown a solution allowing to increase the surface of contact with the friction means 15. Thus the outer cage 28 of the free wheel 29 is provided with an annular side plate 53 which is integral with same in rotation, while being vertically movable. This annular side plate 51 is sandwiched between the friction disc 30B and another friction disc 30C immobilized in rotation inside the recess 22 and onto which rest, through an intermediate disc 54, the parts 51 forming the lever-arm load-transfer means 64.

As can be seen in this FIG. 3, both the annular side plate 53 and the peripheral rim 52 the outer cage of the free wheel 29 is provided with have a larger cross-section than the friction discs 30A, 30B, 30C, so that their peripheral edge 55, 56, respectively, engages into grooves 57, 58 made in the wall of the recess 22. In fact, the width 59 of their peripheral rims 57, 58 delimit the vertical movability of the rim 52 and the annular side plate 53 inside this recess 22 and, accordingly, the maximum rate of wear of the friction discs 30A, 30B.

Thus, once this maximum rate of wear has been reached, the peripheral edge 55, 56 of the rim 52 and the annular side plate 53 rests onto the side wall 60, 61 of the grooves 57, 58, so that this results into such a friction coefficient that the resistance torque it leads to during the control of the up movement of the lifting means 6 is e.g., higher than the power of the driving means 8. In fact, as already described above, this is a safety system which enters into operation only when the operator has not heeded the preferred instructions for replacing the friction discs i.e., opting instead for periodic replacement of the friction disc or discs 30A, 30B, 30C.

This is however only one embodiment. Thus, this safety can be obtained simply when the peripheral rim 52 the outer cage 28 of the free wheel 29 is provided with rests on the bottom 31 of the recess 22 due to complete wear out of the friction disc 30A.

Finally, inasfar as this invention allows to ally at the same time efficiency, safety, quality of operation and long lifetime, it leads to a not inconsiderable technical progress in the field of the lifting devices.

I claim:

1. A lifting device for a load, such as a vehicle, comprising:

a substantially vertical column forming a frame and lifting means movable along said column under the action of a rotation control of a threaded ball driven by a driving means:

a reversible-type nut, such as a ball nut made of one of a polyamide and a compound material for moving along said threaded rod;

friction means capable of creating, during a control of a down movement of said lifting means, a resistance torque of a modulus at least equal to a torque generated by the load resting on said lifting means;

means capable of overcoming said friction means during a control of an up movement of said lifting means; and load-dividing means for transmitting, at a level of said friction means, only a proportional part of the load lifted by said lifting means.

2. The lifting device according to claim 1, said load-dividing means comprising: springy compensating means for absorbing a part of the load borne by said threaded rod and springy means for transmitting to said friction means a remaining load not compensated by said springy compensating means.

3. The lifting device according to claim 1, said friction means and said overcoming means positioned at a level of a bearing block supporting said threaded rod for rotation and including a casing defining a cylindrical recess, said threaded rod including an upper end and a lower end, one end of which penetrates into said cylindrical recess.

4. The lifting device according to claim 3, said load-dividing means comprising springy compensating means for absorbing a part of the load borne by said threaded rod and springy means for transmitting to said friction means a remaining load not compensated by said springy compensating means, said casing including an inner wall having a shoulder, a spring washer, positioned on said shoulder and forming said springy compensating means, and said threaded rod, positioned adjacent said spring washer, provided with a retaining shoulder at said one end.

5. The lifting device according to claim 4, a thrust ball bearing positioned between said retaining shoulder of said threaded rod and said spring washer.

6. The lifting device according to claim 4, said overcoming means comprising a free wheel provided with an outer cage; and said springy means being positioned adjacent said outer cage, said springy means comprising a spring washer, and said threaded rod positioned adjacent said spring washer of said springy means.

7. The lifting device according to claim 6, a spacer means comprising a tubular spacer extending under said retaining shoulder of said threaded rod and being positioned adjacent a thrust ball bearing, said thrust ball bearing being positioned adjacent said spring washer.

8. The lifting device according to claim 2, said springy compensating means being positioned under a lower end of said threaded rod to compensate for a load associated with said rod supported by said lifting means.

9. The lifting device according to claim 4, said springy means being positioned between said friction means and a bearing surface inside said bearing block.

10. The lifting device according to claim 1, said load-dividing means comprising a lever-arm load-transfer means, including a first lever are for transmitting a part of a lifted load directly onto said frame and a second lever arm for transmitting to said friction means another part of said lifted load.

11. The lifting device according to claim 10, said threaded rod comprising a retaining shoulder positioned at an upper end, said retaining shoulder resting adjacent a thrust ball bearing, said thrust ball bearing being positioned at a level of a first bearing point on said load-transfer means which, in turn, rest through a second and third bearing points on said frame of said lifting device and on said friction means, wherein a distance separating said second and third bearing points from said first bearing point determining a length of said lever arms.

12. The lifting device according to claim 11, said lever-arm load-transfer means comprising at least three members distributed around said threaded rod, under a thrust ball bearing, and shaped to define said bearing points.

13. The lifting device according to claim 1, means of which capable of annihilating the action of the friction means during the control of the up movement of the lifting means said overcoming means being formed by a free wheel fitted on said threaded rod and including an outer cage provided with a peripheral rim positioned between said friction means.

14. The lifting device according to claim 13, said outer cage includes an annular side plate integral in rotation with said outer cage, and movable vertically with respect to said outer cage, said annular side plate being positioned between a first friction disc and a second friction disc, said load-dividing means being positioned adjacent said second friction disc.

15. The lifting device according to claim 1, further comprising ancillary braking means operable in an event of said lifting means moving up and said lifting means moving down under no or little load, said ancillary braking means operation ensuring that an upper travel end and a lower travel end of said lifting means are not exceeded.

* * * * *